US005544743A

United States Patent [19]

Hong

[11] Patent Number: 5,544,743

[45] Date of Patent: Aug. 13, 1996

[54] GOLF BAG

[76] Inventor: Bum-Ki Hong, 105-903, Hyundai first APT, 653 Gaepo-dong, Kangnam-gu, Seoul, Rep. of Korea

[21] Appl. No.: 222,749

[22] Filed: Apr. 4, 1994

[51] Int. Cl.[6] ..... A63B 55/00

[52] U.S. Cl. ..... 206/315.3; 206/315.5; 206/315.6; 206/315.8

[58] Field of Search ..... 206/315.6, 315.3, 206/315.8, 315.5

[56] References Cited

U.S. PATENT DOCUMENTS

| | | | |
|---|---|---|---|
| 2,010,961 | 8/1935 | Reach | 206/315.6 |
| 2,294,084 | 8/1942 | Gihon, 3D et al. | 206/315.6 |
| 2,507,249 | 5/1950 | Dorazio | 206/315.8 |
| 3,331,419 | 7/1967 | Bencriscutto | 206/315.6 |
| 3,674,072 | 7/1972 | Shuto | 206/315.6 |
| 3,941,398 | 3/1976 | Nelson | 206/315.6 |
| 4,130,153 | 12/1978 | Zopf | 206/315.6 |
| 4,635,793 | 1/1987 | Kim | 206/315.6 |
| 4,967,904 | 11/1990 | Quellais et al. | 206/315.6 X |
| 5,029,703 | 7/1991 | Dulyea, Sr. | 206/315.6 X |
| 5,123,531 | 6/1992 | Beretta | 206/315.6 X |

FOREIGN PATENT DOCUMENTS

| | | | |
|---|---|---|---|
| 254609 | 5/1963 | Australia | 206/315.4 |
| 21332 | 10/1895 | United Kingdom | 206/315.2 |

*Primary Examiner*—Sue A. Weaver
*Attorney, Agent, or Firm*—Seidel Gonda Lavorgna & Monaco

[57] ABSTRACT

A golf bag keeps golf clubs, golf balls, golf tees and etc. therein. The golf bag comprises an upper holder having both wood club cells and iron club cells for separately distinguishably keeping the iron clubs and the wood clubs. The upper holder is tightly engaged with the top end of a cloth body. The bottom end of the cloth body is provided with snap clips which are detachably engaged with a lower holder by snapping in their respective locking portions of the lower holder. A support column extends between the upper and lower holders for supporting a shape of the golf bag. The snap clips are snapped in the locking portions respectively in order to detachably couple the bottom end of the cloth body to the lower holder. This golf bag prevents the club heads, particularly the wood club heads, from bumping against each other, thus to protect the club heads from damage. The golf bag also makes the club heads distinguishable and easily took out of the bag. Since the pockets for golfer's necessaries are hidden from view, the golf bag provides desired using convenience for the golfer and achieves a good and simple outer appearance.

8 Claims, 5 Drawing Sheets

GOLF BAG

BACKGROUND OF THE INVENTION

1. Field of the Invention

The present invention relates in general to golfing equipment and, more particularly, to a golf bag for keeping golfer's necessaries such as golf clubs, golf balls, golf tees and an umbrella.

2. Description of the Prior Art

Golf is a game that has been popular in many parts of the world for many generations. Part of the game's popularity is due to the fact that it is one of the few "life sports" in which complete retirement because of age is rarely necessary. The golf lets an extremely wide range of people be relieved of fatigue and stress and refresh themselves and provides an excellent vehicle for reasonable exercise for the people. The golf also provides an excellent vehicle for use of spare time and for social intercourse.

The nature of the game requires a substantial amount of golfing equipment, such as golf clubs, golf balls, golf tees and an umbrella, be carried with the golfer as he moves about the course. The golfing equipment to be carried with the golfer are kept in a golf bag. The commercially produced golf bags are somewhat different from each other in their sizes as well as their outer appearances.

As the golfer moves about the course, the golf clubs such as wood clubs and iron clubs are kept together in a golf bag such that they are reversed with their grip ends positioned on the bottom of the golf bag and their heads exposed to the outside of the top of the bag. Here, since the conventional golf bag has no means for partitioning its inside, the expensive golf clubs, particularly the wood clubs, kept together in such a golf bag easily bump against each other at their heads, thus to be scratched and damaged on their heads. In golfing on the ground, it is not easy to find a desired club out of the various clubs kept together in the golf bag with only their heads exposed to the outside of the bag.

In order to combat this problem, the various golf clubs have been provided with distinguishable marks on their heads. However, this still lets the club heads bump against each other. To keep the club heads from bumping against each other as well as to make the club heads distinguishable, the club heads exposed to the outside of the bag are preferably covered with head covers differently colored. However, this method using the differently colored head covers requires the head covers be removed from the club heads every when the clubs are took out of the bag. Hence, use of the head covers can not help introducing somewhat inconvenience to the golfer on the course.

Another problem of the conventional golf bag is resided in that the golf bag keeping the golf clubs easily falls due to its structural instability. That is, since the plurality of golf clubs whose the centers of gravity are positioned on their heads are kept together in the golf bag such that they are reversed with their grip ends positioned on the bottom of the golf bag and their heads protruding out of the top of the bag, the golf bag in keeping the golf clubs is inevitably unstable when standing on the ground. Because of the above structural instability, the golf bag keeping the reversed golf clubs easily falls even by a slight touch when standing on the ground.

SUMMARY OF THE INVENTION

It is, therefore, an object of the present invention to provide a golf bag in which the aforementioned problems can be overcome and into which an upper holder, having a plurality of club head cells, and a detachable lower holder are vertically assembled so that the bag remarkably saves the manufacturing cost, achieves a desired quality and lets the golf clubs be easily took out of it and, as a result, lets the golfer concentrate his attention on playing and makes the golfer proficient in golf.

It is another object of the present invention to provide a golf bag which keeps a plurality of golf clubs therein with the club heads kept in their respective head cells of the upper holder, thus to prevent the club heads from bumping against each other and from damage, and which is covered with cloth on the inner and outer surfaces of its head cells, thus to require the club heads be covered with no additional head covers.

It is a further object of the present invention to provide a golf bag whose pockets for keeping golfer's personal necessaries such as golf balls, golf tees and umbrella is provided inside thereof such that the pockets are hidden from view, thus to show a good outer appearance and provide desired using convenience for the golfer.

In order to accomplish the above objects, a golf bag for keeping a plurality of golf clubs therein in accordance with a preferred embodiments of the present invention comprises an upper holder having a plurality of iron club cells and wood club cells, the iron club cells being provided at opposed sections of the upper holder, the wood club cells being opposed to each other and provided between the opposed iron club cells; a cap detachably attached to the upper holder; a cloth bag body engaged with the upper holder at its top end; a lower holder detachably engaged with the bottom end of the cloth bag body; and a support column detachably connected at its opposed ends to and extending between the upper and lower holders for supporting the shape of the bag.

BRIEF DESCRIPTION OF THE DRAWINGS

The above and other objects, features and other advantages of the present invention will be more clearly understood from the following detailed description taken in conjunction with the accompanying drawings, in which.

DESCRIPTION OF THE PREFERRED EMBODIMENTS

Figure 1:
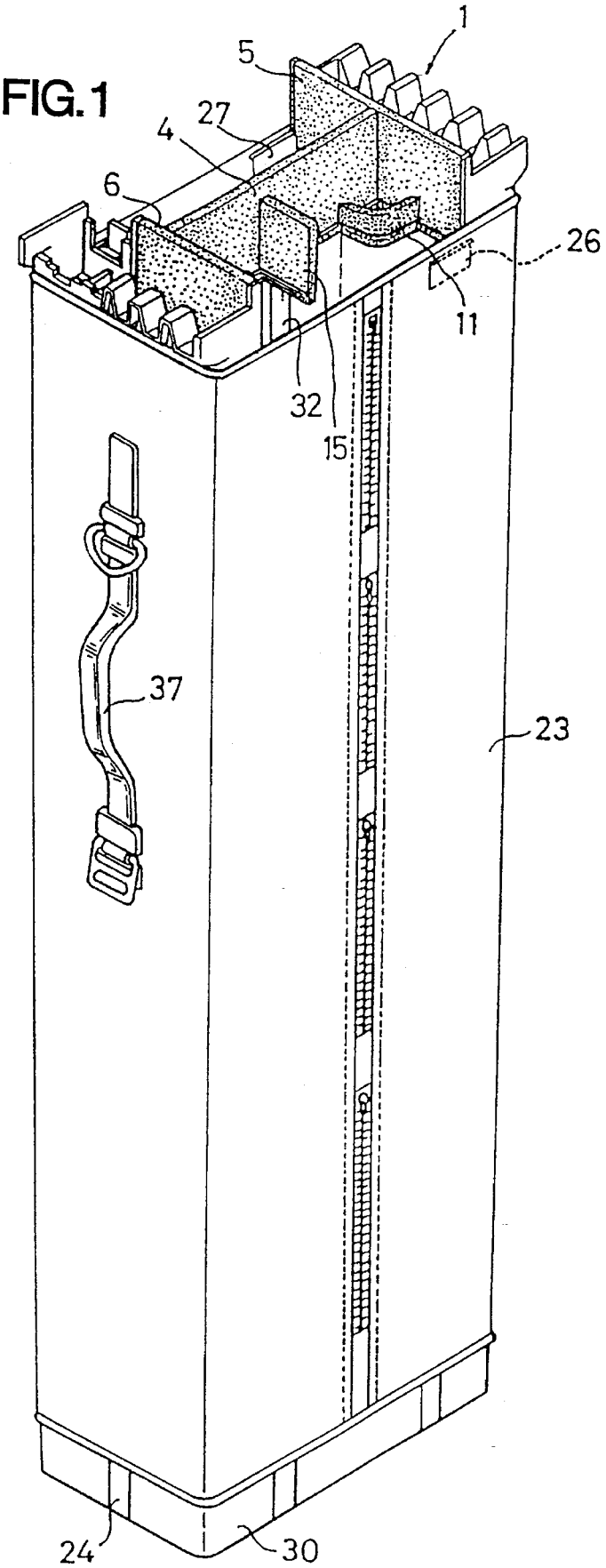
FIG. 1 is a perspective view of a golf bag in accordance with a preferred embodiment of the present invention.
Figure 4:
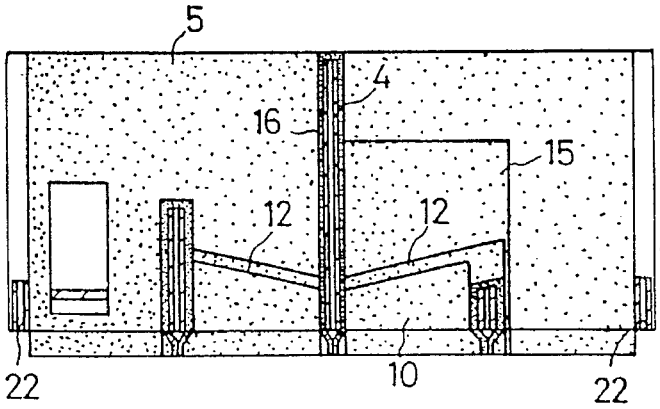
FIG. 4 is a sectional view of the upper holder taken along the section line B—B of FIG. 2.
Figure 5:
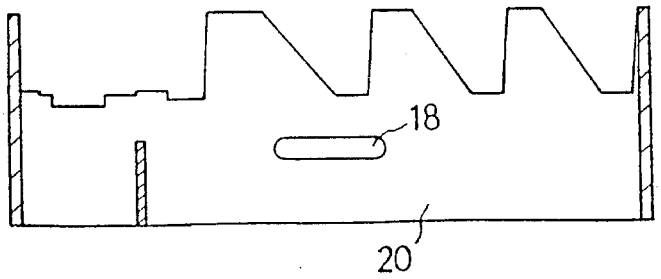
FIG. 5 is a sectional view of the upper holder taken along the section line C—C of FIG. 2.
Figure 6:
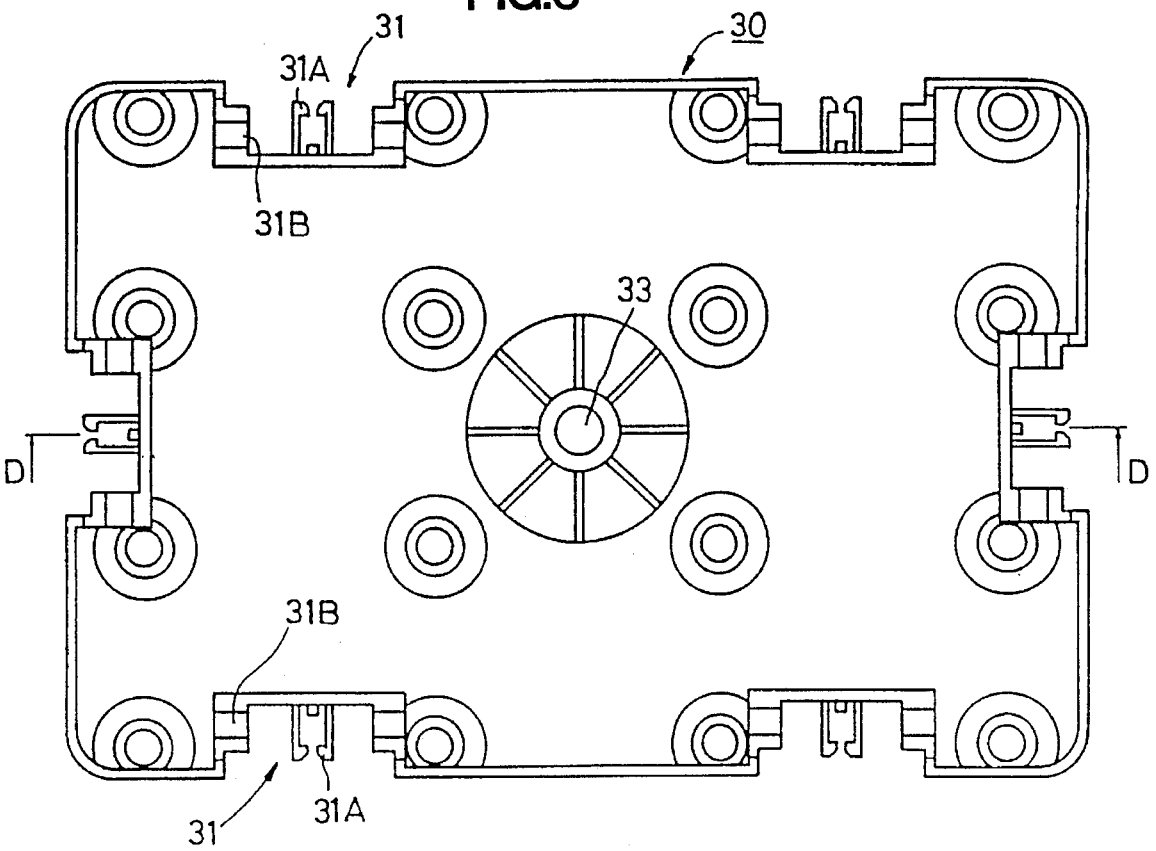
FIG. 6 is a plan view of a detachable lower holder of the golf bag of FIG. 1.
Figure 7:
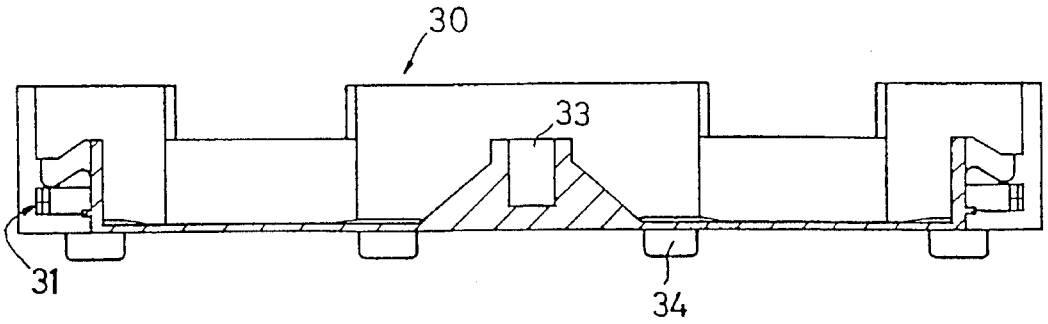
FIG. 7 is a sectional view of the lower holder taken along the section line D—D of FIG. 6.
Figure 8:
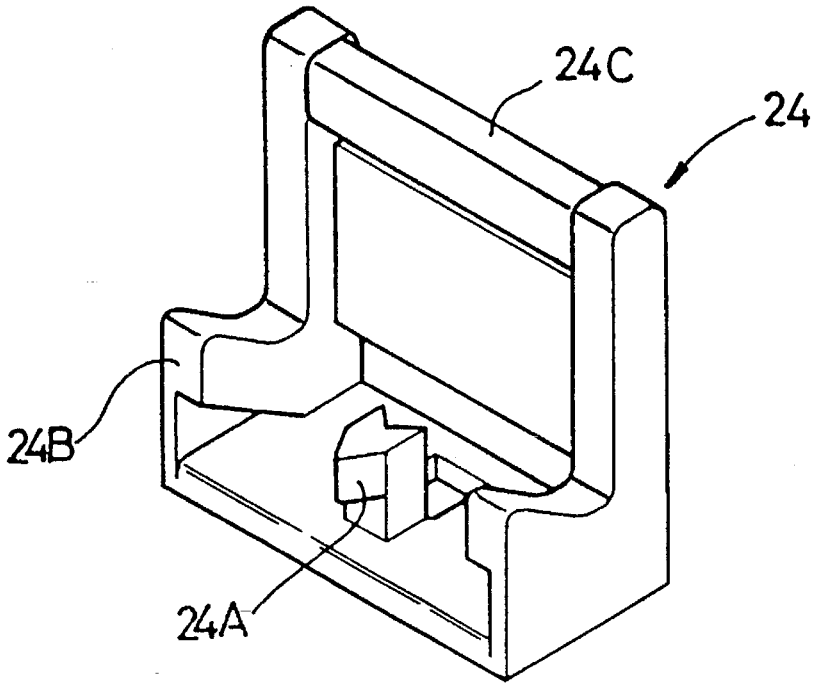
FIG. 8 is a perspective view of a snap clip hung on the bottom end of a cloth body for detachably engaging the cloth body with the lower holder of the golf bag of FIG. 1.
Figure 9:
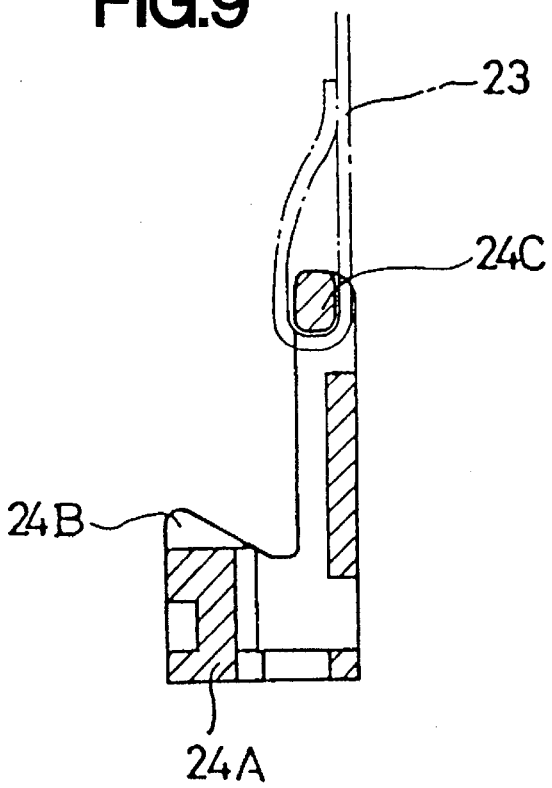
FIG. 9 is a sectional view of the snap clip of FIG. 8.

With reference to the drawings, FIG. 1 shows a golf bag in accordance with a preferred embodiment of the present invention, FIGS. 2 to 5 show an upper holder of the golf bag, FIGS. 6 and 7 show a detachable lower holder of the golf bag, and FIGS. 8 and 9 show a snap clip hung on the bottom end of a cloth body of the golf bag and detachably engaged with a locking portion of the lower holder.

The golf bag, keeping therein a plurality of golf clubs including wood clubs and iron clubs, comprises the upper holder 1 which separately keeps the club heads of golf clubs. Fixed to the upper holder 1 is a top end of a cloth body 23, which cloth body 23 is provided at its bottom end with a plurality of snap clips 24. The snap clips 24 are brought into detachable engagement with the locking portion 31 of the lower holder 30. The upper holder 1, the cloth body 23 having the snap clips 24, and the lower holder 30 are assembled into the golf bag. In addition, a cap (not shown) is preferably attached to the upper holder such that it is detachable.

Figure 2:
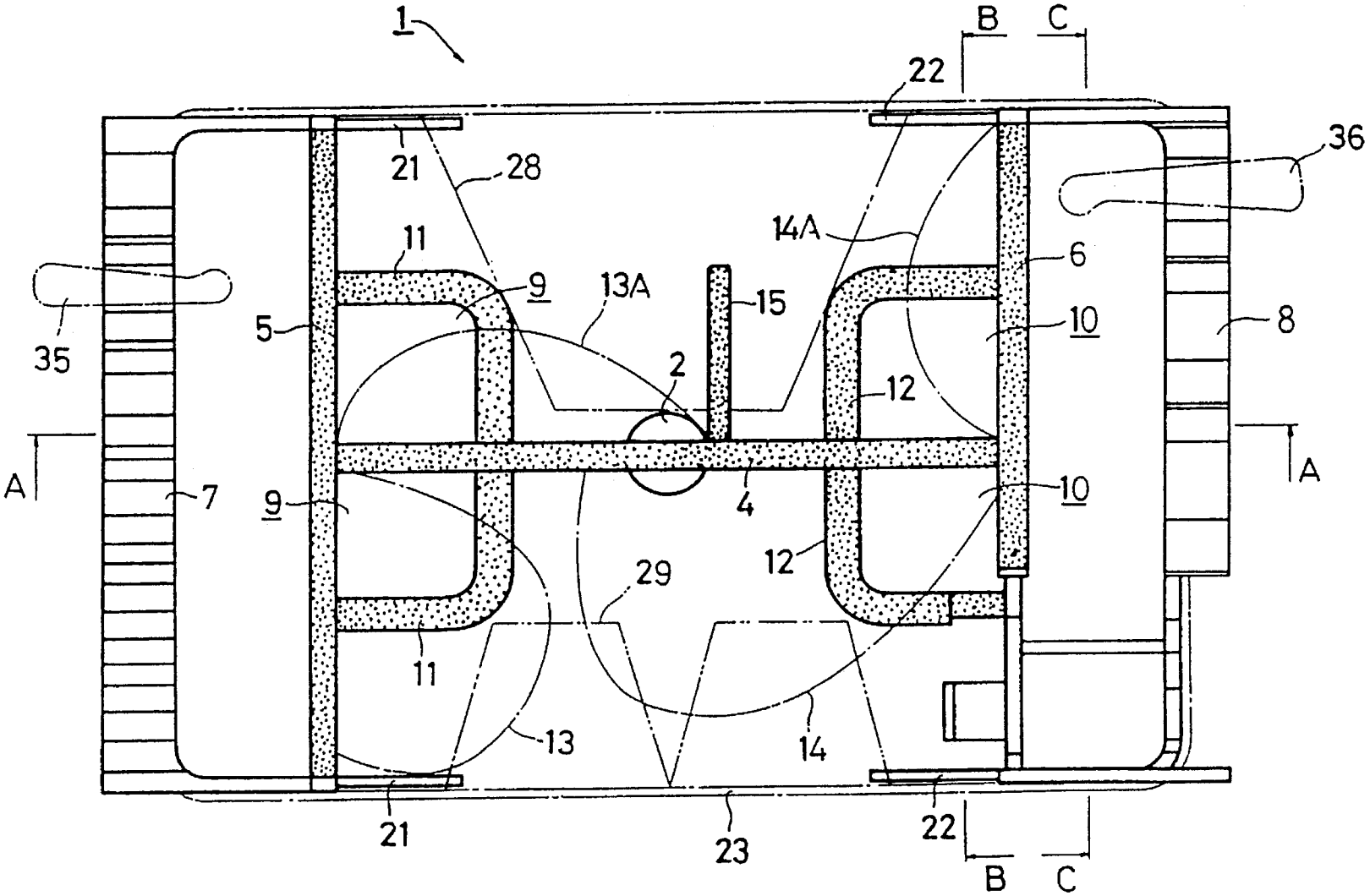
FIG. 2 is a plan view of an upper holder of the golf bag of FIG. 1.
Figure 3:
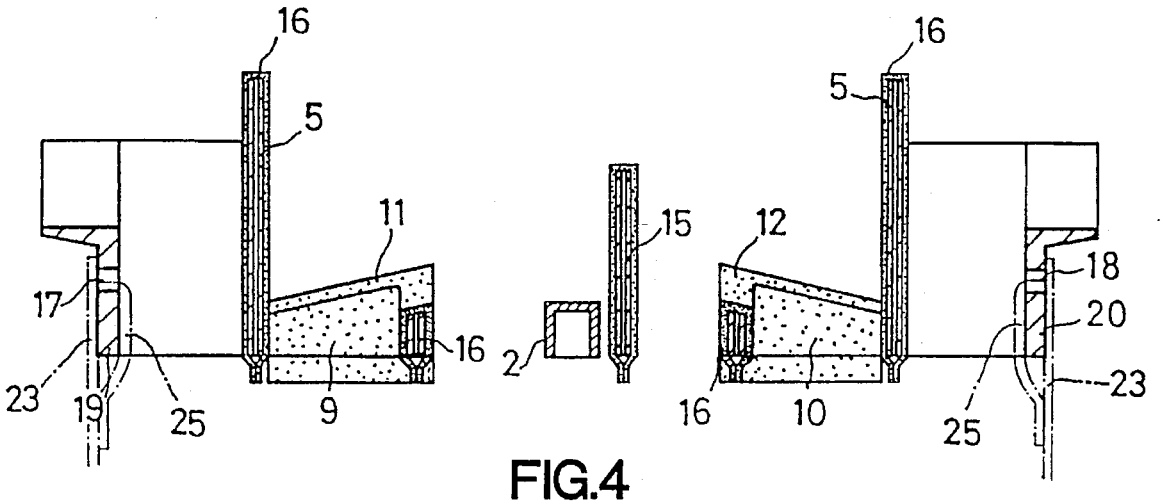
FIG. 3 is a sectional view of the upper holder taken along the section line A—A of FIG. 2.

If described in detail, the upper holder 1 comprises a single body frame which includes an arm 4 provided at its opposed ends with a pair of flanges 5 and 6. The arm 4 has a semicircular insert hole 2 at its outer bottom center for receiving the top end of a support column 32. The flanges 5 and 6 are coupled to the opposed ends of the arm 4 at right angles respectively. At the outside of the flanges 5 and 6, a plurality of iron club cells 7 and 8 are provided and keeps the iron clubs therein. Wood club cells 9 and 10 are defined by support frames 11 and 12 at corners where the arm 4 and the flanges 5 and 6 cross each other. Hence, the wood club cells 9 and 10 are opposed to each other as best seen in FIG. 2. In order to automatically bias the wood clubs 13 and 14 toward the side surfaces of the arm 4 and the flanges 5 and 6 and to make the clubs 13 and 14 closer to the side surfaces, the support frames 11 and 12 defining the wood club cells 9 and 10 are inclined downwards with respect to both the arm 4 and the flanges 5 and 6 as shown in FIGS. 3 and 4. A partition 15 extends outward from a side surface of the arm 4 and prevents the heads of the wood clubs 13A and 14A kept in the cells 9 and 10 from bumping against each other. The arm 4, the flanges 5 and 6, the support frames 11 and 12 and the partition 15 are all covered with cloth 16 on their opposed side surfaces for protecting the heads of the wood clubs 13, 13A, 14 and 14A. The upper holder 1 has opposed side walls 19 and 20 as shown in FIG. 3 and a plurality of opposed fixtures 21 and 22 as shown in FIGS. 2 and 4. The opposed side walls 19 and 20 of the holder 1 is formed with their respective longitudinal holes 17 and 18, as best seen in FIG. 5, for fixing the top end of the cloth body 23 to the upper holder 1.

The cloth body 23 includes a plurality of hanging bands 25, 26 and 27 on its upper inside surface for fixing its top end to the upper holder 1. The hanging bands 25 are inserted into the longitudinal holes 17 and 18 of the upper holder side walls 19 and 20 and, thereafter, sewed on the inside surfaces of the cloth body 23 in order to form closed loops as shown in FIG. 3. The other hanging bands 26 and 27 in the form of closed loop receive the fixtures 21 and 22 of the upper holder 1 respectively. A plurality of pockets 28 and 29 for keeping the golfer's personal necessaries such as golf balls, golf tees and umbrella are provided on the front and rear inside surfaces of the cloth body 23. The snap clips 24, which are to be detachably engaged with the locking portions 31 of the lower holder 30 in order to bring the cloth body 23 into detachable engagement with the lower holder 30, are hung on the bottom end of the cloth body 23 at their hanging beams 24C as shown in FIG. 9. In each of the clips 24 preferably cast in a single body, an insert protrusion 24A which are to be engaged with a corresponding locking portion 31 extends upwards from the bottom center as shown in FIG. 8. Erected at opposed ends of the bottom having the protrusion 24A are J-shaped locking shoulders 24B. The hanging beam 24C extends between the top ends of the locking shoulders 24B.

Turning to FIGS. 6 and 7, the detachable lower holder 30 includes an insert hole 33 at its inside center for detachably receiving the bottom end of the support column 32. The top end of the support column 32 is inserted into the semicircular insert hole 2 of the arm 4 as described above. The plurality of locking portions 31 are formed on the outer surface of the lower holder 30 at positions corresponding to the snap clips 24 of the cloth body 23. When snapping the snap clips 24 in their respective locking portions 31, the detachable engagement of the cloth body 23 with the lower holder 30 is achieved. The outer bottom surface of the lower holder 30 is provided with a plurality of circular protrusions 34 for prevention of unconscious slip on a power cart when the golf bag is carried with the golfer as the golfer moves about the course riding on the power cart.

In assembling the parts, that is, the upper holder 1, the cloth body 23 and the lower holder 30, into the golf bag, the top end of the cloth body 23 is engaged with the upper holder 1 at first. That is, the cloth body 23, having a size as well as a shape corresponding to the rectangular side walls 19 and 20 of the upper holder 1, is engaged upwardly with the side walls 19 and 20. In this case, the hanging bands 25, 26 and 27 of the cloth body 23 are engaged with the longitudinal holes 17 and 18 of the side walls 19 and 20 and the fixtures 21 and 22 of the upper holder 1 and, thereafter, sewed on the cloth body 23 at their free ends to form the closed loops, thus to achieve the engagement.

The support column 32 is, thereafter, positioned in its place between the upper and lower holders 1 and 30 by inserting its top and bottom ends into the semicircular insert hole 2 of the arm 4 of the upper holder 1 and the insert hole 33 of the lower holder 30 respectively. Thereafter, the snap clips 24 hung on the bottom end of the cloth body 23 at their hanging beams 24C are snapped in their respective locking portions 31 of the lower holder 30, so that the detachable engagement of the cloth body 23 with the lower holder 30 is achieved. In this case, the insert protrusion **24*a* of each snap clip 24 is inserted into a pair of elastic holders 31A of a corresponding locking portion 31 of the lower holder 30, thus to prevent lateral play of the snap clip 24 in the locking portion 31. At the same time, the pair of locking shoulders 24B of each snap clip 24 are snapped in their places on a pair of shoulders 31B of the locking portion 31, thus to prevent vertical play of the snap clip 24 in the locking portion 31. The pair of shoulders 31B are integrally formed with the lower holder 30 at opposed sides of the elastic holders 31A as shown in FIG. 6. The assembling of the parts into the golf bag is terminated by the detachable engagement of the cloth body 23 with the lower holder 30**.

When keeping the golf clubs in the golf bag, the plurality of iron clubs 35 and 36 are kept in order in their respective cells 7 and 8 provided at the opposed sections of the upper holder 1 while the wood clubs 13 and 14 are kept in their respective cells 9 and 10 formed at corners where the arm 4 and the flanges 5 and 6 cross each other (see FIG. 2). In this regard, it is facilitated to take a desired golf club out of the golf bag in golfing on the course, so that the golf bag of this invention lets the golfer concentrate his attention on playing and makes the golfer proficient in golf.

In the golf bag of this invention, the wood club cells 9 and 10 for keeping the wood clubs 13 and 14 are defined by the arm 4, the flanges 5 and 6 and the support frames 11 and 12 which are all covered on their opposed side surfaces with the cloth 16. With the cloth 16, the heads of the wood clubs 13 and 14 are protected from damage and, as a result, there is no necessity for additional head covers so that the golf bag of this invention saves time and cost.

When shouldering the golf bag with a shoulder belt 37, the wood clubs 13 and 14 kept in the wood club cells 9 and 10 formed on one side of the arm 4 are biased to the arm 4 and the flanges 5 and 6 to be close to them respectively, so that their heads are reliably prevented from bumping against each other. At the same time, the heads of the wood clubs 13A and 14A kept in the wood club cells 9 and 10 formed on the other side of the arm 4 are prevented from bumping against each other by the partition 15 extending from the side surface of the arm 4. As a result, the golf bag of this invention reliably prevents the heads of the wood clubs 13, 13A, 14 and 14A kept in their respective cells 9 and 10 from bumping against each other and from damage.

As shown at the phantom line of FIG. 2, the golf bag is provided inside thereof with pockets for keeping golfer's personal necessaries such as golf balls, golf tees and umbrella. With the inside pockets, the golf bag of this invention provides desired convenience for the golfer. Furthermore, since the pockets are hidden from view, the golf bag shows a good and simple outer appearance and is facilitated to be handled.

As described above, the golf bag according to the present invention comprises an upper holder having both wood club cells and iron club cells for separately distinguishably keeping the iron clubs and the wood clubs. The upper holder is tightly engaged with the top end of a cloth body. The bottom end of the cloth body is provided with snap clips which are detachably engaged with a lower holder by snapping in their respective locking portions of the lower holder. The golf bag of this invention prevents the club heads, particularly the wood club heads, from bumping against each other, thus to protect the club heads from damage. In addition, the golf bag makes the club heads distinguishable so that it facilitates taking the clubs out of the bag. With the inside pockets hidden from view, the golf bag provides desired using convenience for the golfer and achieves a good and simple outer appearance.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

What is claimed is:

1. A golf bag comprising:

an upper holder having at least one longitudinal hole and an upper insert hole, said upper holder being partitioned, by a pair of flanges crossing opposed ends of an arm, into iron club cell sections provided at the outside of said flanges and a wood club cell section provided between said flanges and divided into two parts by said arm, each said iron club cell section having means defining a plurality of iron club cells while said wood club cell section having a plurality of wood club cells, wherein a plurality of support frames are mounted on said arm and said flanges for defining said wood club cells in said wood club cell section in cooperation with both said arm and said flanges, said support frames being inclined downward from their top ends towards said arm and said flanges;

a cloth body including means for coupling said body to said upper holder at its top end;

a lower holder including means for detachably coupling said lower holder to a bottom end of said cloth body wherein said lower holder has a lower insert hole; and a support column extending between said upper and lower holders for supporting a shape of said golf bag, said column being detachably coupled to said upper insert hole and lower insert hole of said upper and lower holders at its opposed ends.

2. The golf bag according to claim 1, wherein said means for coupling said cloth body to said upper holder further includes a plurality of fixtures.

3. The golf bag according to claim 2, wherein said cloth body is provided at front and rear inside surfaces with a plurality of pockets for golfer's necessaries such that said pockets do not project outwardly from the cloth body.

4. The golf bag according to claim 1, wherein said upper holder further includes a partition extending outward from a side surface of said arm for prevention of wood club heads in said wood club cells from bumping against each other.

5. The golf bag according to claim 4, wherein said wood club cells are covered with cloth on their side surfaces for protection of wood club heads.

6. The golf bag according to claim 1, wherein said wood club cells are covered with cloth on their side surfaces for protection of wood club heads.

7. The golf bag according to claim 1, wherein said cloth body is provided at front and rear inside surfaces with a plurality of pockets for golfer's necessaries such that said pockets do not project outwardly from the cloth body.

8. The golf bag according to claim 1, wherein said means for detachably coupling said lower holder to said cloth body includes a plurality of snap clips at a bottom end of said cloth body and a plurality of locking portions on an outer surface of said lower holder at positions corresponding to said snap clips, said snap clips being snapped in said locking portions respectively in order to detachably couple said bottom end and of the cloth body to said lower holder.

* * * * *